US008001641B1

(12) United States Patent
Williams

(10) Patent No.: US 8,001,641 B1
(45) Date of Patent: Aug. 23, 2011

(54) UTILITY KNIFE ASSEMBLY AND METHOD

(76) Inventor: Joseph N. Williams, Valley Stream, NY (US)

( * ) Notice: Subject to any disclaimer, the term of this patent is extended or adjusted under 35 U.S.C. 154(b) by 10 days.

(21) Appl. No.: 12/502,479

(22) Filed: Jul. 14, 2009

(51) Int. Cl.
*B25B 11/00* (2006.01)
*B26B 3/06* (2006.01)

(52) U.S. Cl. ..... 7/163; 30/162

(58) Field of Classification Search ..... 7/163, 164, 7/158, 161; 30/162, 335, 337
See application file for complete search history.

(56) References Cited

U.S. PATENT DOCUMENTS

| | | | | |
|---|---|---|---|---|
| 228,115 | A * | 5/1880 | Randell | 7/163 |
| 2,952,025 | A * | 9/1960 | Johnson | 7/163 |
| 4,993,093 | A | 2/1991 | Goldwitz | |
| 5,206,965 | A | 5/1993 | Rowley | |
| 5,289,637 | A | 3/1994 | Coffey | |
| 6,367,154 | B2 * | 4/2002 | Degabli | 7/163 |
| D479,114 | S * | 9/2003 | Onion | D8/99 |
| D509,419 | S * | 9/2005 | Chung | D8/99 |
| D511,447 | S | 11/2005 | Brown et al. | |
| 7,266,854 | B1 | 9/2007 | Gomez | |
| D588,433 | S * | 3/2009 | van Deursen | D8/99 |
| 7,621,503 | B2 * | 11/2009 | Warren et al. | 254/26 R |
| 7,726,031 | B1 * | 6/2010 | Gibbs | 30/335 |
| 2007/0283570 | A1 | 12/2007 | Huang | |
| 2008/0086894 | A1 * | 4/2008 | Sullivan | 30/155 |

* cited by examiner

*Primary Examiner* — Hadi Shakeri

(57) ABSTRACT

A utility knife assembly includes a housing that has a first lateral wall, a second lateral wall and a perimeter wall extending between the first and second lateral walls. The perimeter wall includes a front wall, a rear wall, an upper wall and a lower wall. The front wall has a blade aperture therein. The upper wall has a slot therein. A tape measure tab is removably positionable in the slot. A blade is removably mounted to the housing and extends outwardly of the blade aperture. The slot is aligned with the blade to allow the tape measure to be used for measuring where the blade is cutting.

9 Claims, 3 Drawing Sheets

UTILITY KNIFE ASSEMBLY AND METHOD

BACKGROUND OF THE DISCLOSURE

1. Field of the Disclosure

The disclosure relates to utility knife devices and more particularly pertains to a new utility knife device for assisting a person in cutting at a selected measurement.

2. Summary of the Disclosure

An embodiment of the disclosure meets the needs presented above by generally comprising a housing that has a first lateral wall, a second lateral wall and a perimeter wall extending between the first and second lateral walls. The perimeter wall includes a front wall, a rear wall, an upper wall and a lower wall. The front wall has a blade aperture therein. The upper wall has a slot therein. A tape measure tab is removably positionable in the slot. A blade is removably mounted to the housing and extends outwardly of the blade aperture. The slot is aligned with the blade to allow the tape measure to be used for measuring where the blade is cutting.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
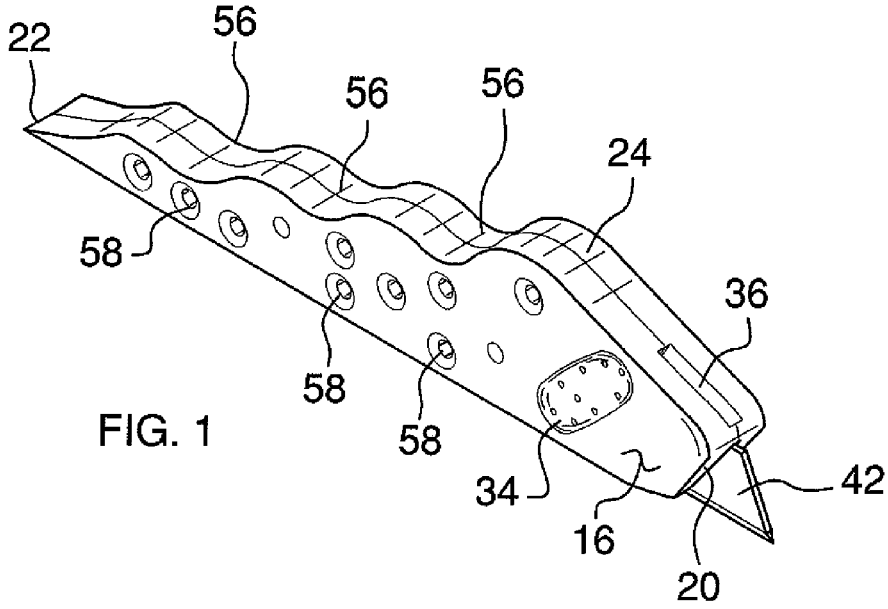
FIG. 1 is a front perspective view of a utility knife assembly and method according to an embodiment of the disclosure.
Figure 2:
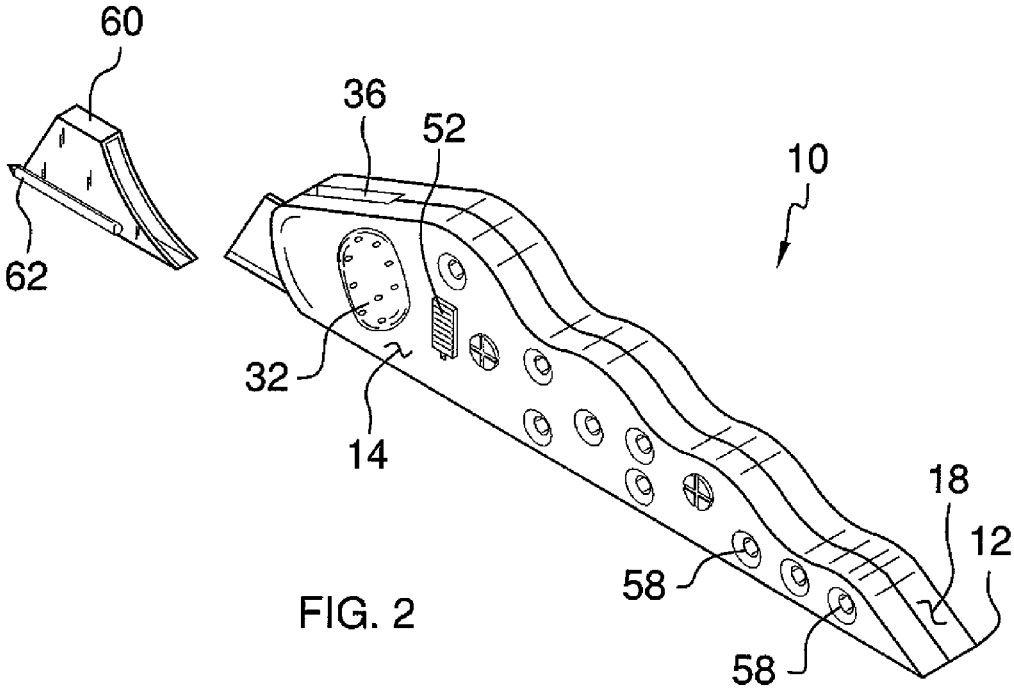
FIG. 2 is a rear perspective view of an embodiment of the disclosure.
Figure 3:
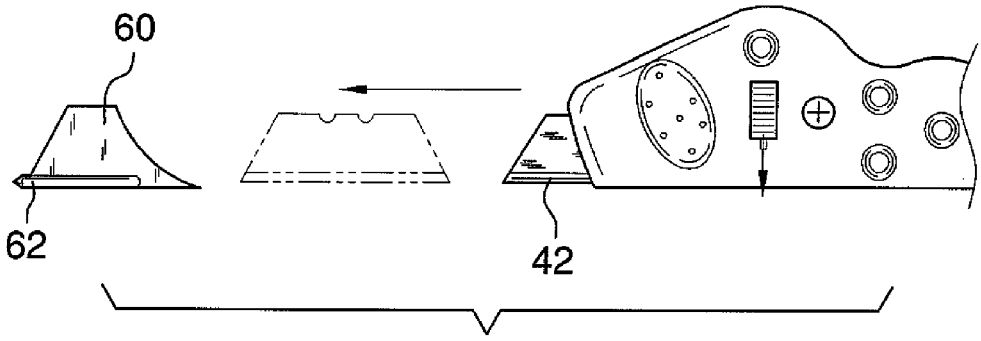
FIG. 3 is a side expanded view of an embodiment of the disclosure.
Figure 4:
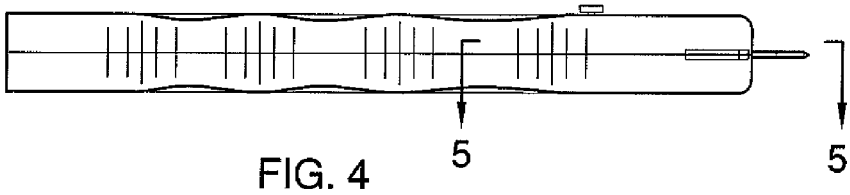
FIG. 4 is a top view of an embodiment of the disclosure.
Figure 5:
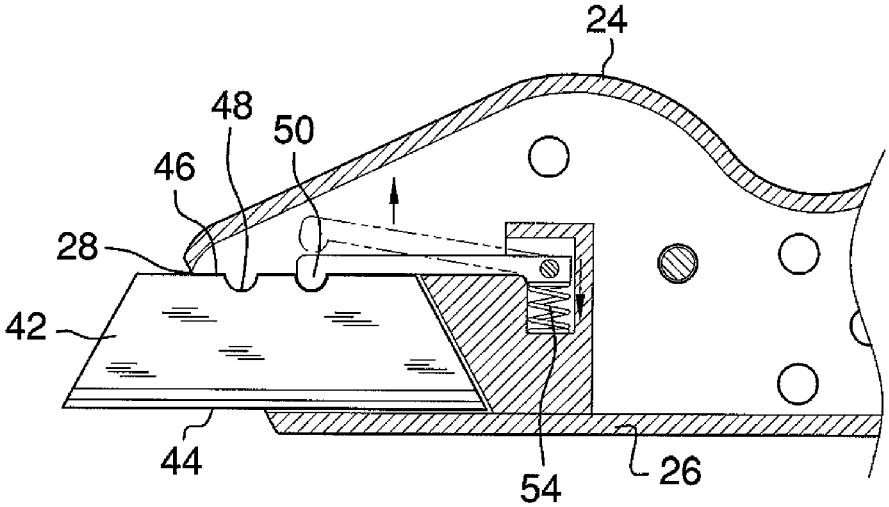
FIG. 5 is a cross-sectional view taken along line 5-5 of FIG. 4 of an embodiment of the disclosure.

With reference now to the drawings, and in particular to FIGS. 1 through 7 thereof, a new utility knife device embodying the principles and concepts of an embodiment of the disclosure and generally designated by the reference numeral 10 will be described.

As best illustrated in FIGS. 1 through 7, the utility knife assembly 10 and method generally comprises a housing 12 has a first lateral wall 14, a second lateral wall 16 and a perimeter wall 18 extending between the first 14 and second 16 lateral walls. The perimeter wall 18 includes a front wall 20, a rear wall 22, an upper wall 24 and a lower wall 26. The front wall 20 has a blade aperture 28 therein. A plurality of measuring indicia 30 is positioned on an outer surface of the lower wall 26. A thumb grip 32 is positioned in the first lateral wall 14 and is positioned nearer to the front wall 20 than the rear wall 22. Another thumb grip 34 may be positioned in the second lateral wall 16.

The upper wall 24 has a slot 36 therein. A tape measure 38 tab 40 is removably positionable in the slot 36. The slot 36 is elongated along a line orientated parallel to a longitudinal axis of the housing 12 extending through the front 20 and rear 22 walls. The slot 36 is positioned nearer to the front wall 20 than the rear 22 wall.

A blade 42 is removably mounted to the housing 12 and extends outwardly of the blade aperture 28. The blade 42 has a sharpened edge 44 extending along the lower wall 26. The blade 42 has an engagement edge 46 having notches 48 therein into which a rod 50 is positioned to releasably secure the blade 42 to the housing 12. The rod 50 is pivotably movable within the housing 12 to selectively release the blade 42 so that the blade 42 may be replaced as needed. A slide button 52 is attached to the rod 50 and positioned outside of the housing 12. The slide button 52 is moved in a first direction to pivot the rod 50 and release the blade 42. A biasing member 54 biases the slide button 52 in a second direction.

The upper wall 24 has a plurality of grooves 56 therein. The upper 24 and lower 24 walls taper toward each other from a central area of the housing 12 to the rear wall 22. The grooves 56 provide a plurality of finger gripping areas for a person gripping the housing 12.

The housing 12 has a plurality of openings 58 extending therethrough. Each of the openings 58 extends through each of the first 14 and second 16 lateral walls. The openings 58 are used for a person desiring to draw circles with the housing 12. The openings 58 are spaced from each other to provide a plurality of available diameters of circles.

A cover 60 is removably attached to the housing 12 and covers the blade 42. The cover 60 frictionally engages the housing 12. The cover 60 may have a bottom side having a graphite marking member 62 mounted thereon so that it may be used for marking materials to be cut with the blade 42.

Figure 6:
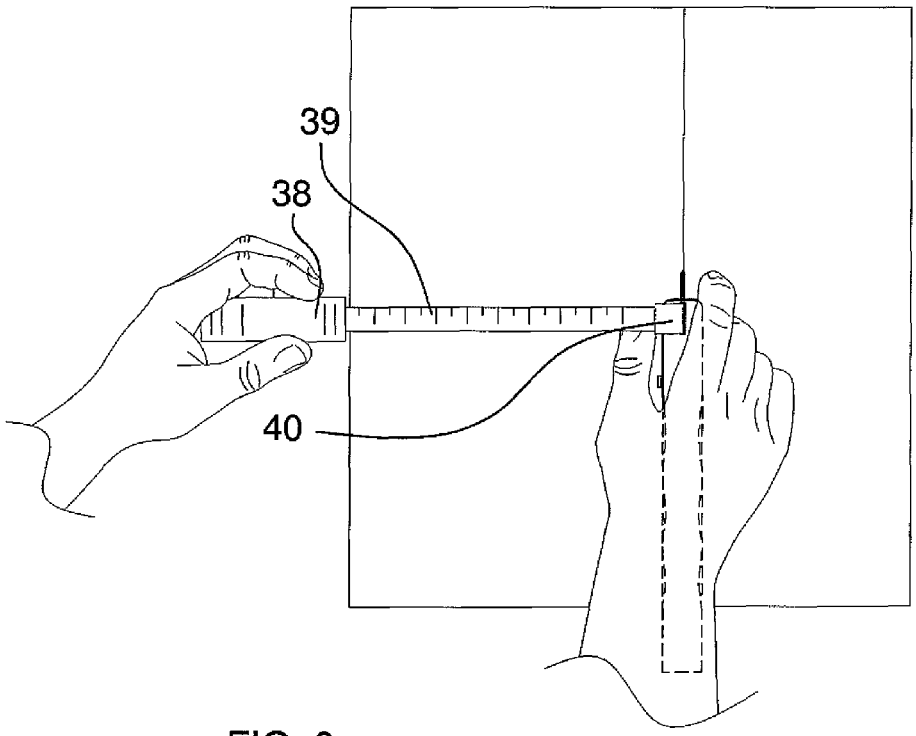
FIG. 6 is a top in-use view of an embodiment of the disclosure.
Figure 7:
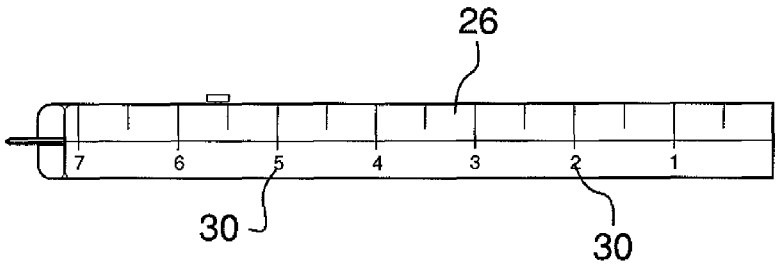
FIG. 7 is a bottom view of an embodiment of the disclosure.

In use, the tab 40 attached to the tape 39 of a tape measure 38 is extended into the slot 36 and the tape measure 38 used to determine where a cut should be made by measuring the same with the tape measure 38. The user may slide the tape measure 38 along the material being cut to along a line orientated perpendicular to the tape 39 as shown in FIG. 6. This allows the user to easily and quickly cut a straight line where needed, such as in drywall type material.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A knife assembly comprising:

a housing having a first lateral wall, a second lateral wall and a perimeter wall extending between said first and second lateral walls, said perimeter wall including a front wall, a rear wall, an upper wall and a lower wall, said front wall having a blade aperture therein;

said upper wall having a slot therein, a tape measure tab being removably positionable in said slot;

a blade being removably mounted to said housing and extending outwardly of said blade aperture, said slot being aligned with said blade;

said housing has a plurality of openings extending therethrough, each of said openings extending through each of said first and second lateral walls; and a cover being removably attached to said housing and covering said blade, said covering having a bottom side, a graphite marking member being mounted to said bottom side to facilitate marking of materials to be cut with said blade.

2. The assembly according to claim 1, wherein said slot is elongated along a line orientated parallel to a longitudinal axis of said housing extending through said front and rear walls.

3. The assembly according to claim 2, wherein said slot is positioned nearer to said front wall than said rear wall.

4. The assembly according to claim 1, wherein said upper wall has a plurality of grooves therein.

5. The assembly according to claim 4, wherein said upper and lower walls taper toward each other from a central area of said housing to said rear wall.

6. The assembly according to claim 1, further including a plurality of measuring indicia being positioned on an outer surface of said lower wall.

7. The assembly according to claim 1, further including a thumb grip being positioned in said first lateral wall, said thumb grip being positioned nearer to said front wall than said rear wall.

8. A knife assembly comprising:

a housing having a first lateral wall, a second lateral wall and a perimeter wall extending between said first and second lateral walls, said perimeter wall including a front wall, a rear wall, an upper wall and a lower wall, said front wall having a blade aperture therein;

said upper wall having a slot therein, a tape measure tab being removably positionable in said slot, said slot being elongated along a line orientated parallel to a longitudinal axis of said housing extending through said front and rear walls, said slot being positioned nearer to said front wall than said rear wall;

a blade being removably mounted to said housing and extending outwardly of said blade aperture, said blade having a sharpened edge extending along said lower wall;

said upper wall having a plurality of grooves therein, said upper and lower walls tapering toward each other from a central area of said housing to said rear wall;

said housing having a plurality of openings extending therethrough, each of said openings extending through each of said first and second lateral walls;

a cover being removably attached to said housing and covering said blade;

a plurality of measuring indicia being positioned on an outer surface of said lower wall; and a thumb grip being positioned in said first lateral wall, said thumb grip being positioned nearer to said front wall than said rear wall.

9. The assembly according to claim 8, wherein said covering has a bottom side, a graphite marking member being mounted to said bottom side to facilitate marking of materials to be cut with said blade.

* * * * *